US009948003B2

(12) United States Patent
Harper et al.

(10) Patent No.: US 9,948,003 B2
(45) **Date of Patent: *Apr. 17, 2018**

(54) LOOP ANTENNA FOR MOBILE HANDSET AND OTHER APPLICATIONS

(71) Applicant: Microsoft Technology Licensing, LLC, Redmond, WA (US)

(72) Inventors: Marc Harper, Issaquah, WA (US); Devis Iellici, Cambridge (GB); Christopher Tomlin, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/282,100

(22) Filed: Sep. 30, 2016

(65) Prior Publication Data

US 2017/0018839 A1 Jan. 19, 2017

Related U.S. Application Data

(60) Continuation of application No. 14/789,817, filed on Jul. 1, 2015, now Pat. No. 9,543,650, which is a (Continued)

(30) Foreign Application Priority Data

Oct. 15, 2010 (GB) ..... 1017472.0

(51) Int. Cl.
*H01Q 1/24* (2006.01)
*H01Q 5/378* (2015.01)
(Continued)

(52) U.S. Cl.
CPC ..... *H01Q 5/378* (2015.01); *H01Q 1/243* (2013.01); *H01Q 1/38* (2013.01); *H01Q 1/48* (2013.01);
(Continued)

(58) Field of Classification Search
CPC ..... H01Q 7/00; H01Q 7/005
(Continued)

(56) References Cited

U.S. PATENT DOCUMENTS 3,993,998 A 11/1976 Kimmett
4,940,992 A 7/1990 Nguyen et al.
(Continued)

FOREIGN PATENT DOCUMENTS

EP 0584882 A1 3/1994
EP 1063722 A2 12/2000
(Continued)

OTHER PUBLICATIONS

"Notice of Allowance Issued in Taiwan Patent Application No. 100137082", dated Apr. 27, 2016, 4 Pages.
(Continued)

*Primary Examiner* — Huedung Mancuso
(74) *Attorney, Agent, or Firm* — Holzer Patel Drennan

(57) ABSTRACT

There is disclosed an antenna system for mobile handsets and other devices. The antenna system comprises a dielectric substrate having first and second opposed surfaces, a conductive track on the substrate, and a separate, directly driven antenna to drive the parasitic loop antenna formed by the conductive track. Two grounding points are provided adjacent to each other on the first surface of the substrate, with the arms of the conductive track extending in generally opposite directions from the grounding points. The conductive tracks then extend towards an edge of the dielectric substrate, before passing to the second surface of the dielectric substrate and then passing across the second surface of the dielectric substrate following a path generally following the path taken on the first surface of the dielectric substrate. The conductive tracks then connect to respective sides of a conductive arrangement formed on the second surface of the
(Continued)

dielectric substrate that extends into a central part of a loop formed by the conductive track on the second surface of the dielectric substrate.

20 Claims, 8 Drawing Sheets

Related U.S. Application Data division of application No. 13/878,971, filed as application No. PCT/GB2011/051837 on Sep. 28, 2011, now Pat. No. 9,502,771.

(51) Int. Cl.

| | |
|---|---|
| ***H01Q 1/38*** | (2006.01) |
| ***H01Q 7/00*** | (2006.01) |
| ***H01Q 5/321*** | (2015.01) |
| ***H01Q 5/364*** | (2015.01) |
| ***H01Q 9/26*** | (2006.01) |
| ***H01Q 5/392*** | (2015.01) |
| ***H01Q 1/48*** | (2006.01) |

(52) U.S. Cl.
CPC ..... *H01Q 5/321* (2015.01); *H01Q 5/364* (2015.01); *H01Q 5/392* (2015.01); *H01Q 7/00* (2013.01); *H01Q 7/005* (2013.01); *H01Q 9/26* (2013.01)

(58) Field of Classification Search
USPC ..... 343/870, 702, 744, 866, 749
See application file for complete search history.

(56) References Cited

U.S. PATENT DOCUMENTS

| | | | | |
|---|---|---|---|---|
| 5,973,650 | A | 10/1999 | Nakanishi | |
| 6,104,354 | A | 8/2000 | Hill et al. | |
| 6,118,411 | A | 9/2000 | Hasegawa et al. | |
| 6,456,243 | B1 | 9/2002 | Poilasne et al. | |
| 6,583,764 | B2 | 6/2003 | Ieda et al. | |
| 7,068,230 | B2 | 6/2006 | Qi et al. | |
| 7,439,916 | B2 * | 10/2008 | Wang | H01Q 1/243 343/700 MS |
| 7,489,276 | B2 | 2/2009 | Qi et al. | |
| 7,768,466 | B2 | 8/2010 | Chi et al. | |
| 8,256,684 | B2 | 9/2012 | Sugita et al. | |
| 8,446,706 | B1 | 5/2013 | Kamath et al. | |
| 8,654,023 | B2 | 2/2014 | Brown et al. | |
| 8,854,273 | B2 | 10/2014 | Li et al. | |
| 8,933,852 | B2 | 1/2015 | Wong et al. | |
| 9,124,001 | B2 | 9/2015 | Wong et al. | |
| 9,276,317 | B1 | 3/2016 | Zheng | |
| 2003/0112185 | A1 | 6/2003 | Fang et al. | |
| 2003/0112193 | A1 | 6/2003 | Briggs | |
| 2006/0109183 | A1 | 5/2006 | Rosenberg et al. | |
| 2008/0122710 | A1 | 5/2008 | Kim et al. | |
| 2008/0169991 | A1 | 7/2008 | Takemura et al. | |
| 2008/0291100 | A1 | 11/2008 | Chi et al. | |
| 2009/0135077 | A1 | 5/2009 | Kim et al. | |
| 2009/0256763 | A1 | 10/2009 | Chi et al. | |
| 2009/0275370 | A1 * | 11/2009 | Schlub | H01Q 1/243 455/575.7 |
| 2010/0033380 | A1 * | 2/2010 | Pascolini | H01Q 1/243 343/700 MS |
| 2013/0201074 | A1 | 8/2013 | Harper et al. | |
| 2015/0303570 | A1 | 10/2015 | Harper et al. | |

FOREIGN PATENT DOCUMENTS

| | | | |
|---|---|---|---|
| EP | 1120855 | A2 | 8/2001 |
| EP | 1267441 | A2 | 12/2002 |
| EP | 1416585 | A1 | 5/2004 |
| EP | 1778663 | A1 | 5/2004 |
| EP | 1555717 | A1 | 7/2005 |
| EP | 1806907 | A1 | 7/2007 |
| EP | 2065975 | A1 | 6/2009 |
| GB | 692692 | | 6/1953 |
| GB | 2403350 | A | 12/2004 |
| GB | 2472779 | A | 2/2011 |
| GB | 2484540 | A | 4/2012 |
| JP | 483465 | A | 1/1973 |
| JP | 54034739 | A | 3/1979 |
| JP | H10173425 | A | 6/1998 |
| JP | 2000196337 | A | 7/2000 |
| JP | 2002043826 | | 2/2002 |
| JP | 2005117099 | | 4/2005 |
| JP | 2005167619 | | 6/2005 |
| JP | 2007288561 | | 11/2007 |
| JP | 2007336331 | | 12/2007 |
| JP | 2008042600 | | 2/2008 |
| JP | 2008092259 | | 4/2008 |
| JP | 2008511234 | A | 4/2008 |
| JP | 2008190689 | A | 8/2008 |
| JP | 5018114 | B2 | 9/2012 |
| TW | 200952256 | A | 12/2009 |
| WO | 2003096478 | A1 | 11/2003 |
| WO | 2004057698 | A2 | 7/2004 |
| WO | 2006021914 | A1 | 3/2006 |
| WO | 2006049382 | A1 | 5/2006 |
| WO | 2007020728 | A1 | 2/2007 |
| WO | 2008070337 | A2 | 6/2008 |
| WO | 2008082697 | A2 | 7/2008 |
| WO | 2012049473 | A2 | 4/2012 |

OTHER PUBLICATIONS

"Notice of Allowance Issued in United Kingdom Patent Application No. 1017472.0", dated Dec. 31, 2013, 2 Pages.
"Notice of Allowance Issued in European Patent Application No. 11764605.9", dated Jan. 3, 2017, 7 Pages.
"Notice of Allowance Issued in Chinese Patent Application No. 201180049862.8", dated May 20, 2015, 4 Pages.
"Search Report Issued in European Patent Application No. 16189540.4", dated Feb. 22, 2017, 7 Pages.
"Notice of Allowance Issued in United Kingdom Patent Application No. 1309731.6", dated Jan. 20, 2015, 2 Pages.
"Notice of Allowance Issued in U.S. Appl. No. 13/878,971", dated Feb. 18, 2016, 8 Pages.
"Supplemental Notice of Allowance Issued in U.S. Appl. No. 13/878,971", dated Oct. 14, 2016, 2 Pages.
"Notice of Allowance Issued in U.S. Appl. No. 13/878,971", dated Jul. 13, 2016, 8 Pages.
"Notice of Allowance Issued in U.S. Appl. No. 14/789,817", dated Oct. 14, 2016, 2 Pages.
"Notice of Allowance Issued in U.S. Appl. No. 14/789,817", dated Jul. 22, 2016, 8 Pages.
"Notice of Allowance Issued in U.S. Appl. No. 13/878,971", dated Apr. 4, 2016, 8 Pages.
"Notice of Allowance Issued in U.S. Appl. No. 13/878,971", dated Dec. 9, 2015, 8 Pages.
Di Nallo et al "Mutliband internal antenna for mobile phones," Electronic Letters, vol. 41, Issue 9, dated Apr. 28, 2005, pp. 514-515 (http://ieeexplore.org/xpl/articleDetails.jsp?arenumber).
International Search Report and Written Opinion for corresponding PCT Application No. PCT/GB2011/0513837, dated Oct. 10, 2012, 26 Pages.
International Bureau on behalf of the International Searching Authority, International Preliminary Report on Patentability for PCT/GB2011/051837, dated Apr. 16, 2013,17 pages.
Office Action issued in United Kingdom Patent Application No. 1017472.0, dated Apr. 17, 2013, 2 Pages.
Office Action issued in United Kingdom Patent Application No. 1017472.0, dated Jun. 10, 2013, 2 Pages
Search Report issued in United Kingdom Patent Application No. 1309731.6, dated Jul. 3, 2013, 6 Pages.
Office Action issued in United Kingdom Patent Application No. 1017472.0, dated Jul. 17, 2013, 2 Pages.

(56) References Cited

OTHER PUBLICATIONS

Office Action Received in United Kingdom Patent Application No. 1309731.6, dated Mar. 3, 2014, 2 Pages.
Search Report, State Intellectual Property Office of People's Republic China, Application No. 201180049862.8, dated Apr. 18, 2014, 3 pages.
First Office Action issued in Chinese Patent Application No. 20110049862.8; issued date: Apr. 30, 2014; dated May 26, 2014, 10 pages.
Office Action Issued in United Kingdom Patent Application No. 1309731.6, dated Nov. 19, 2014, 2 Pages.
Second Office Action Issued in Chinese Patent Application No. 201180049862.8, dated Dec. 5, 2014, 7 Pages.
Office Action Issued in Japanese Patent Application No. 2013-533279, dated Jun. 16, 2015, 6 Pages. (w/o English Translation).
Non-Final Office Action Issued in U.S. Appl. No. 13/878,971, dated Aug. 13, 2015, 8 Pages.
Office Action issued in Russian Patent Application No. 2013120482, dated Sep. 1, 2015, 4 pages W/O English Translation.
Office Action issued in Russian Patent Application No. 2013120482, dated Jan. 13, 2016, 10 pages W/O English Translation.
Office Action Issued in Taiwan Patent Application No. 100137082, dated Jan. 19, 2016, 8 Pages.
Office Action issued in Japanese Patent Application No. 2013533279, dated Feb. 9, 2016, 6 pages W/O English Translation.
Non-Final Office Action Issued in U.S. Appl. No. 14/789,817, dated Apr. 1, 2016, 7 Pages.
Office Action issued in European Patent Application No. 11764605., dated May 24, 2016, 5 Pages.
Notice of Allowance Issued in Japanese Patent Application No. 2013-533279, dated Aug. 16, 2016, 3 Pages. (W/o English Translation).
"Office Action Issued in Canadian Patent Application No. 2813829", dated Jul. 12, 2017, 4 Pages.
"Office Action Issued in Korean Patent Application No. 10-2013-7010843", dated Apr. 17, 2017, 11 Pages.
"Office Action Issued in Korean Patent Application No. 10-2013-7010843", dated Oct. 28, 2017, 5 Pages.
"Notice of Allowance Issued in Taiwan Patent Application No. 105116685", dated Oct. 27, 2017, 6 Pages.
"Office Action Issued in Canadian Patent Application No. 2,813,829", dated Jan. 31, 2018, 3 Pages.

* cited by examiner

| MARKERS: | MHz | dB | MHz | dB |
|---|---|---|---|---|
| 10000_mxh_Inductivereflexus HFSSDesign1.s1p | | | | |
| | 1: 824 | -0.96 | 3: 1710 | -4.22 |
| | 2: 960 | -1.79 | 4: 2170 | -5.68 |
| MatchedData | | | | |
| | 1: 824 | -9.67 | 3: 1710 | -8.50 |
| | 2: 960 | -10.25 | 4: 2170 | -15.72 |

| MARKERS: | MHz | dB | MHz | dB |
|---|---|---|---|---|
| GSM.s1p | | | | |
| ——— | 1: 824 | -5.69 | 3: 1710 | -3.95 |
| | 2: 960 | -4.88 | 4: 1990 | -3.80 |
| Trans.S1P | | | | |
| ——— | 1: 824 | -32.93 | 3: 1710 | -35.20 |
| | 2: 960 | -52.01 | 4: 1990 | -40.20 |

LOOP ANTENNA FOR MOBILE HANDSET AND OTHER APPLICATIONS

CROSS-REFERENCE TO RELATED APPLICATIONS AND PRIORITY CLAIM

The present application is a continuation of U.S. patent application Ser. No. 14/789,817 filed Jul. 1, 2015 and titled "A LOOP ANTENNA FOR MOBILE HANDSET AND OTHER APPLICATIONS," which is a divisional application under 35 U.S.C. § 121 of U.S. patent application Ser. No. 13/878,971 filed Apr. 11, 2013 and titled "A LOOP ANTENNA FOR MOBILE HANDSET AND OTHER APPLICATIONS," which claims benefit of priority to PCT/GB2011/051837 entitled "A LOOP ANTENNA FOR MOBILE HANDSET AND OTHER APPLICATIONS" and filed on Sep. 28, 2011, which takes priority from U.K. Patent Application GB 1017472.0, entitled "A LOOP ANTENNA FOR MOBILE HANDSET AND OTHER APPLICATIONS" and filed Oct. 15, 2010, all of which are specifically incorporated by reference herein for all that they disclose or teach.

SUMMARY

This invention relates to a loop antenna for mobile handset and other applications, and in particular to a loop antenna that is able to operate in more than one frequency band.

BACKGROUND

The industrial design of modern mobile phones leaves little printed circuit board (PCB) area for the antenna and often the antenna must be very low profile because of the increasing demand for slimline phones. At the same time the number of frequency bands that the antenna is expected to operate over is increasing.

When multiple radio protocols are used on a single mobile phone platform, the first problem is to decide whether a single wideband antenna should be used or whether multiple narrower band antennas would be more appropriate. Designing a mobile phone with a single wideband antenna involves problems not only with obtaining sufficient bandwidth to cover all the necessary bands but also with the difficulties associated with the insertion loss, cost, bandwidth and size of the circuits needed to diplex the signals together. On the other hand, multiple narrow-band antenna solutions are associated with problems dominated by the coupling between them and the difficulties of finding sufficient real estate for them on the handset. Generally, these multiple antenna problems are harder to solve than the wide-band single antenna problems.

Most mobile phones generally make use of monopole antennas or PIFAs (Planar Inverted F Antennas). Monopoles work most efficiently in areas free from the PCB groundplane or other conductive surfaces. In contrast, PIFAs will work well close to conductive surfaces. Considerable research effort goes into making monopoles and PIFAs operate as broadband antennas so as to avoid the issues associated with multiple antennas.

One way to increase bandwidth in an electrically small antenna is to use multi-moding. In the lowest bands, odd resonant modes may be created which may be variously designated as 'unbalanced modes', 'differential modes' or 'monopole-like'. At higher frequencies both even and odd resonant modes may created. Even modes may be variously designated as 'balanced modes', 'common modes' or 'dipole-like'.

Loop antennas are well-understood and have been used in mobile phones before. An example is US 2008/0291100 which describes a single band grounded loop radiating in the low band together with a parasitic grounded monopole radiating in the high band. A further example is WO 2006/049382 which discloses a symmetrical loop antenna structure that has been reduced in size by stacking the loop vertically. A broadband characteristic has been obtained in the high frequency band by attaching a stub to the top patch of the antenna. This arrangement creates a multi-moding antenna useful in wireless communication fields.

The idea of multi-moding an antenna is also not new. An example of good design practice here is the Motorola® Folded Inverted Conformal Antenna (FICA), which excites resonances in a structure that exhibits odd and even resonant modes [Di Nallo, C. and Faraone, A.: "Multiband internal antenna for mobile phones", Electronics Letters 28 Apr. 2005 Vol. 41 No. 9]. Two modes are described as being synthesised for the high band: a 'differential mode', featuring opposite phased currents on the FICA arms and transverse currents on the PCB ground and a 'slot mode', which is a higher order common mode, featuring a strong excitation of the FICA slot. The combination of modes can be used to produce a wide, continuous radiating band. However, the FICA structure referred to is a variation of the PIFA and the Nallo and Faraone paper does not teach multi-moding of loop antennas.

BRIEF SUMMARY OF THE DISCLOSURE

Embodiments of the present invention make use of a loop antenna design that has been multi-moded. Embodiments of the present invention are useful in mobile phone handsets, and may also be used in mobile modem devices, for example USB dongles and the like for allowing a laptop computer to communicate with the internet by way of a mobile network.

According to a first aspect of the present invention there is provided a loop antenna comprising a dielectric substrate having first and second opposed surfaces and a conductive track formed on the substrate, wherein there is provided a feed point and a grounding point adjacent to each other on the first surface of the substrate, with the conductive track extending in generally opposite directions from the feed point and grounding point respectively, then extending towards an edge of the dielectric substrate, then passing to the second surface of the dielectric substrate and then passing across the second surface of the dielectric substrate along a path generally following the path taken on the first surface of the dielectric substrate, before connecting to respective sides of a conductive arrangement formed on the second surface of the dielectric substrate that extends into a central part of a loop formed by the conductive track on the second surface of the dielectric substrate, wherein the conductive arrangement comprises both inductive and capacitive elements.

The conductive arrangement can be considered to be electrically complex, in that it includes both inductive and capacitive elements. The inductive and capacitive elements maybe lumped components (e.g. as discrete surface mount inductors or capacitors), but in preferred embodiments they are formed or printed as distributed components, for example as regions of appropriately shaped conductive track on or in the second surface of the substrate.

This arrangement differs from that disclosed in WO 2006/049382 in that the latter describes a folded loop antenna having a stub on the top surface that expands the bandwidth of the high frequency band of the antenna. WO 2006/049382 makes clear that 'the stub is a line that is additionally connected to a transmission line for the purpose of frequency tuning or broadband characteristic'. The stub is a 'shunt stub connected in parallel to the top patch and is the open stub whose length is smaller than λ/4'. It is also made clear in WO 2006/049382 that 'when the length [stub] L is smaller than λ/4, the open stub acts as a capacitor'. In the present invention, the antenna includes a series complex structure at, or near, a center of the loop instead of the simple capacitive shunt stub described in WO 2006/049382.

In both the lumped and the distributed cases, the conductive arrangement of embodiments of the present invention is smaller than the shunt stub described in WO2006/049382 and allows the overall antenna structure to be made more compact. A further advantage of this structure is that it allows the impedance bandwidth of the high band to be tuned without any deleterious effects on the low band. This allows the high band match to be much improved.

Inductive and capacitive elements may be provided in the central region of the loop on the second surface of the substrate by forming the conductive tracks on the second surface of the substrate to define at least one slot, for example by running one track into the central region and then generally parallel to the other track but not galvanically contacting the other track.

It will be appreciated that the conductive track forms a loop with two arms, the loop starting at the feed point and terminating at the grounding point. The two arms of the loop initially extend away from each other starting at the feed point and grounding point respectively, before extending towards the edge of the dielectric substrate. In preferred embodiments, the arms are collinear when initially extending from the feed and grounding points, and generally or substantially parallel when extending towards the edge of the dielectric substrate, although other configurations (for example diverging or converging towards the edge of the dielectric substrate) are not excluded.

In particularly preferred embodiments, the arms of the loop extend towards each other along or close to the edge of the dielectric substrate. The arms may extend so that they come close to each other (for example as close as or closer than the distance between the feed point and the grounding point), or less close to each other. In other embodiments, one arm of the loop may extend along or close to the edge of the substrate while the other does not. In other embodiments, it is conceivable that the arms do not extend towards each other.

The conductive track on the first surface of the dielectric substrate may pass through the dielectric substrate to the second surface by means of vias or holes. Alternatively, the conductive track may pass over the edge of the dielectric substrate from one surface to the other. It will be appreciated that the conductive track passes from one side of the substrate to the other side of the substrate at two locations. Both of these passages may be through vias or holes, or both may be over the edge of the substrate, or one may be through a via or hole and the other may be over the edge.

The loop formed by the conductive track and the loading plate may be symmetrical in a mirror plane perpendicular to a plane of the dielectric substrate and passing between the feed point and the grounding point to the edge of the substrate. In addition, the conductive track, notwithstanding the loading plate, may be generally symmetrical about a mirror plane defined between the first and second surfaces of the substrate. However, other embodiments may not be symmetrical in these planes. Non-symmetrical embodiments may be useful in creating an unbalanced loop which may improve bandwidth, especially in higher bands. However, a consequence of this is that the antenna becomes less resistant to detuning when there is a change in the shape or size of the groundplane.

Advantageously, the conductive track may be provided with one or more spurs extending from the loop generally defined by the conductive track. The one or more spurs may extend into the loop, or out of the loop, or both. The additional spur or spurs act as radiating monopoles and contribute additional resonances in the spectrum, thereby increasing the bandwidth of the antenna.

Alternatively or in addition, there may be provided at least one parasitic radiating element. This may be formed on the first or second surface of the substrate, or on a different substrate (for example a motherboard on which the antenna and its substrate is mounted). The parasitic radiating element is a conductive element that may be grounded (connected to a groundplane) or ungrounded. By providing a parasitic radiating element, it is possible to add a further resonance that may be used for an additional radio protocol, for example Bluetooth® or GPS (Global Positioning System) operation.

In some embodiments, antennas of the present invention may operate in at least four, and preferably at least five different frequency bands.

According to a second aspect of the present invention there is provided a parasitic loop antenna comprising a dielectric substrate having first and second opposed surfaces and a conductive track formed on the substrate, wherein there is provided a first ground point and a second ground point adjacent to each other on the first surface of the substrate, with the conductive track extending in generally opposite directions from the first and second ground points respectively, then extending towards an edge of the dielectric substrate, then passing to the second surface of the dielectric substrate and then passing across the second surface of the dielectric substrate along a path generally following the path taken on the first surface of the dielectric substrate, before connecting at a conductive loading plate formed on the second surface of the dielectric substrate that extends into a central part of a loop formed by the conductive track on the second surface of the dielectric substrate, and wherein there is further provided a separate, directly driven antenna configured to excite the parasitic loop antenna.

The separate driven antenna may take the form of a smaller loop antenna located on adjacent a portion of the conductive track extending from the first ground point, the second loop antenna having a feed point and a ground point and configured to drive the parasitic loop antenna by inductively coupling therewith. The drive antenna may be formed on a motherboard to which the parasitic loop antenna and its substrate is attached.

Alternatively, the separate drive antenna may take the form of a monopole antenna, preferably a short monopole, located and configured so as to drive the parasitic loop antenna by capacitively coupling therewith. The monopole may be formed on a reverse side of a motherboard to which the parasitic loop antenna and its substrate is attached.

WO 2006/049382 describes a classical half-loop antenna that has been compacted by means of a vertical stack structure. Typically a half-loop antenna comprises a conductive element that is fed at one end and grounded at the other. The second aspect of the present invention is a radiating loop antenna that is grounded at both ends and which is therefore parasitic. This parasitic loop antenna is excited by a separate driven antenna, generally smaller than the parasitic loop antenna. The driven or driving antenna may be configured to radiate at a higher frequency of interest, such as one of the WiFi frequency bands.

The loading plate may be generally rectangular in shape, or may have other shapes, for example taking a triangular form. The loading plate may additionally be provided with arms or spurs or other extensions extending from a main part of the loading plate. The loading plate is formed as a conductive plate on the second surface of the substrate, parallel to the substrate as a whole. One edge of the loading plate may follow, on the second surface, a line formed between the feed point and the grounding point on the first surface. An opposed edge of the loading plate may be located generally in the center of the loop formed by the conductive track on the second surface.

According to a third aspect of the present invention there is provided a parasitic loop antenna comprising a dielectric substrate having first and second opposed surfaces and a conductive track formed on the substrate, wherein there is provided a first ground point and a second ground point adjacent to each other on the first surface of the substrate, with the conductive track extending in generally opposite directions from the first and second ground points respectively, then extending towards an edge of the dielectric substrate, then passing to the second surface of the dielectric substrate and then passing across the second surface of the dielectric substrate along a path generally following the path taken on the first surface of the dielectric substrate, before connecting to respective sides of a conductive arrangement formed on the second surface of the dielectric substrate that extends into a central part of a loop formed by the conductive track on the second surface of the dielectric substrate, wherein the conductive arrangement comprises both inductive and capacitive elements, and wherein there is further provided a separate, directly driven antenna configured to excite the parasitic loop antenna.

The third aspect of the present invention combines the parasitic excitation mechanism of the second aspect with the electrically complex conductive arrangement of the first aspect.

In a fourth aspect, which may be combined with any of the first to third aspect, the loop antenna, instead of being directly grounded, is grounded though a complex load selected from the list comprising: least one inductor, at least one capacitor; at least one length of transmission line; and any combination of these in series or in parallel.

Furthermore, the grounding point of the loop antenna may be switched between several different complex loads so as to enable the antenna to cover different frequency bands.

The various embodiments of the present invention already described may be configured either surface mount (SMT) components that may be reflowed onto a ground plane free area of a main PCB, or as elevated structures that work over a groundplane.

It has further been found that removing substrate material in the region of high electric field strength may be used to reduce losses. For example, a central notch may be cut into the substrate material of the loop antenna where the E-field is highest resulting in improved performance in the high frequency band.

For the antenna having a complex central loading structure, it has been found advantageous to make two cut-outs either side of the center line. Again the efficiency benefits are mainly in the high frequency band.

The loop antenna may be arranged so as to leave a central area free for a cut-out right through part of the antenna substrate. The objective here is not so much to reduce losses but rather to create a volume where a micro-USB connector or the like may be placed. It is often desirable to locate the antenna in the same place as connectors, for example at the bottom of a mobile phone handset.

In a further embodiment it has found that short capacitive or inductive stubs may be attached to a driven or parasitic loop antenna to improve the bandwidth, impedance match and/or efficiency. The idea of using a single shunt capacitive stubs has been previously been disclosed in GB0912368. 8 and WO 2006/049382, however it has been found particularly advantageous to use several such stubs, as part of the central complex load. The stubs may also be used advantageously when connected to other parts of the loop structure, as already described in the present Applicant's co-pending UK patent application no GB0912368.8.

It has been found that embodiments of the present invention may be used in combination with an electrically small FM radio antenna tuned to band 88-108 MHz with one antenna disposed each side of the main PCB, i.e. one on the top surface and one directly below it on the undersurface. It is usually a problem to use two antennas so closely spaced because of the coupling between them but it has been found that the loop design of embodiments of the present invention and the nature of the FM antenna (itself a type of loop) is such that very good isolation may exist between them.

Electrically small monopoles and PIFAs are characterised by a high reactive impedance that is capacitive in nature in the same way that a short open-ended stub on a transmission line is capacitive. Most loop antenna configurations have a low reactive impedance that is inductive in nature in the same way that a short-circuited stub on a transmission line is inductive. There are difficulties in matching both these types of antenna to a 50 ohm radio system. Like monopoles and PIFAs, loop antennas can be short circuited to ground so as to be unbalanced or monopole-like. In this case the loop may act as a half-loop and 'see' its image in the groundplane. Alternatively a loop antenna may be a complete loop with balanced modes requiring no groundplane for operation.

Embodiments of the present invention comprise a grounded loop that is driven in both odd and even modes so as to operate over a very wide bandwidth. The operation of the antenna will be explained in more detail below.

BRIEF DESCRIPTION OF THE DRAWINGS

Embodiments of the invention are further described hereinafter with reference to the accompanying drawings, in which.

DETAILED DESCRIPTION

Figure 1:
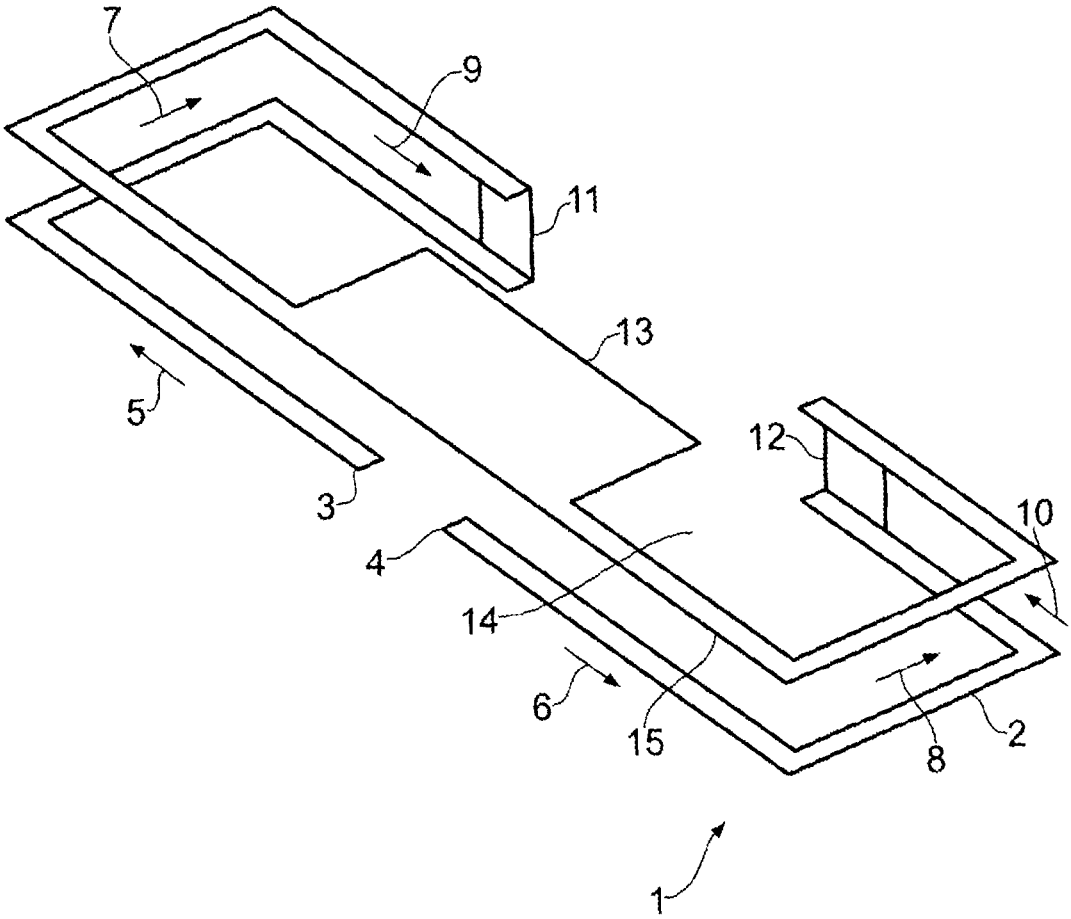
FIG. 1 shows an example antenna.

FIG. 1 shows in schematic form a prior art loop antenna generally similar to that disclosed in WO 2006/049382. The dielectric substrate, which will typically be a slab of FR4 PCB substrate material, is not shown in FIG. 1 for the sake of clarity. The antenna 1 comprises a loop formed of a conductive track 2 extending between a feed point 3 and a grounding point 4 both located adjacent to each other on a first surface (in this case an underside) of the substrate. The conductive track 2 extends in generally opposite directions 5, 6 from the feed point 3 and grounding point 4 respectively, then extends 7, 8 towards an edge of the dielectric substrate, then passes 9, 10 along the edge of the dielectric substrate before passing 11, 12 to the second surface of the dielectric substrate. The conductive track 2 then passes across the second surface of the dielectric substrate along a path generally following the path taken on the first surface of the dielectric substrate, before connecting at a conductive loading plate 13 formed on the second surface of the dielectric substrate that extends into a central part 14 of a loop 15 formed by the conductive track 2 on the second surface of the dielectric substrate.

It can be seen that the conductive track 2 is folded so as to cover the upper and lower layers of the slab of FR4 substrate material. The feed point 3 and grounding point 4 are on the lower surface and may be interchanged if the groundplane is symmetrical through the same axis of symmetry as the antenna 1 as a whole. In other words, if the antenna 1 is symmetrical, then either terminal point 3, 4 may be used as the feed and the other for grounding. Generally, both feed point 3 and grounding point 4 will be on the same surface of the antenna substrate, since the motherboard on which the antenna 1 as a whole will be mounted can feed the points 3 and 4 from only one of its surfaces. However, it is possible to use holes or vias through the substrate so that feed tracks can be formed on either surface and still connect to the respective feed point 3 or grounding point 4. The conductive loading plate 13 is located on the upper surface of the antenna close to the electrical center of the loop 15.

Given that the greatest dimension of the loop 15 is 40 mm, it can be appreciated that the conductive track 2 as a whole is approximately half a wavelength long in the mobile communications low band (824-960 MHz) where the wavelength is around 310-360 mm. In this situation the input impedance of the loop is capacitive in nature and leads to an increased radiation resistance and a lower Q (a larger bandwidth) than is common for a loop antenna. The antenna thus works well in the low band and it is not too difficult to match over required bandwidth. Because the antenna 1 is formed as a loop that is folded over onto itself, its self-capacitance helps to reduce the operating frequency in certain embodiments.

Figure 2:
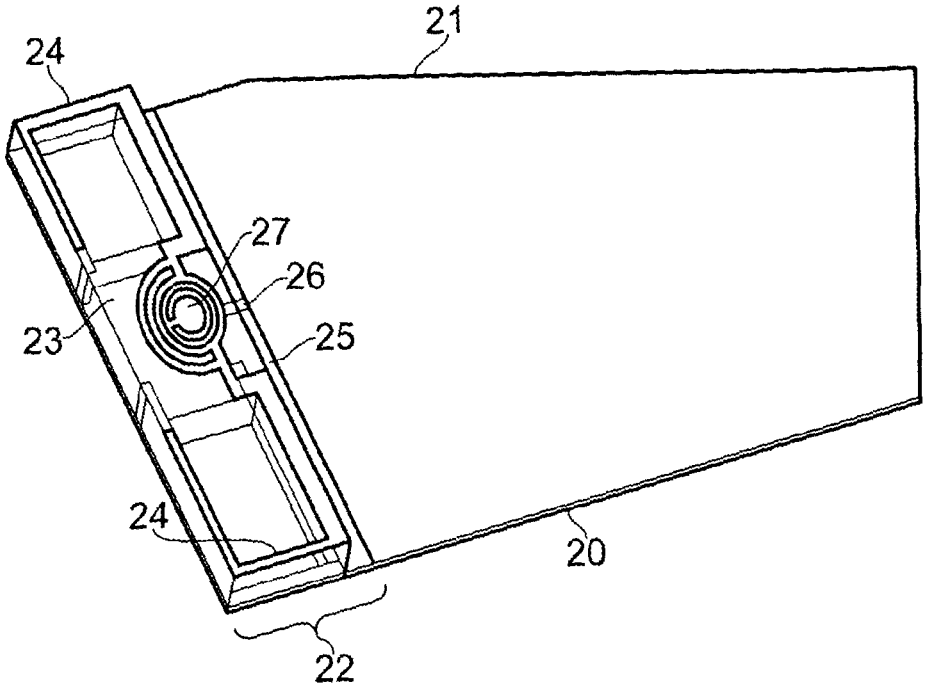
FIG. 2 shows an embodiment of the present invention with an electrically complex central load.

FIG. 2 shows an improvement over the prior art antenna of FIG. 1. There is shown a PCB substrate 20 including a conductive groundplane 21. The PCB substrate 20 has an edge portion 22 that is free of the groundplane 21 for mounting an antenna structure 22 of an embodiment of the present invention. The antenna structure 22 comprises a dielectric substrate 23 (for example FR4 or Duroid® or the like) with first and second opposed surfaces. A conductive track 24 is formed (for example by way of printing) on the substrate 23 having a similar overall configuration to that shown in FIG. 1, namely that of a vertically-compacted loop with a feed point 26 and a grounding point 25 adjacent to each other on the first surface of the substrate, with the conductive track 24 extending in generally opposite directions from the feed point 26 and grounding point 25 respectively, then extending towards an edge of the dielectric substrate 23, then passing to the second surface of the dielectric substrate 23 and then passing across the second surface of the dielectric substrate 23 along a path generally following the path taken on the first surface of the dielectric substrate 23. The two ends of the conductive track 24 on the second surface of the substrate 23 then connect to respective sides of a conductive arrangement 27 formed on the second surface of the dielectric substrate 23 that extends into a central part of a loop formed by the conductive track 24 on the second surface of the dielectric substrate 23, wherein the conductive arrangement 27 comprises both inductive and capacitive elements. In comparison with the arrangement of FIG. 1, the high band match is much improved.

Figure 3:
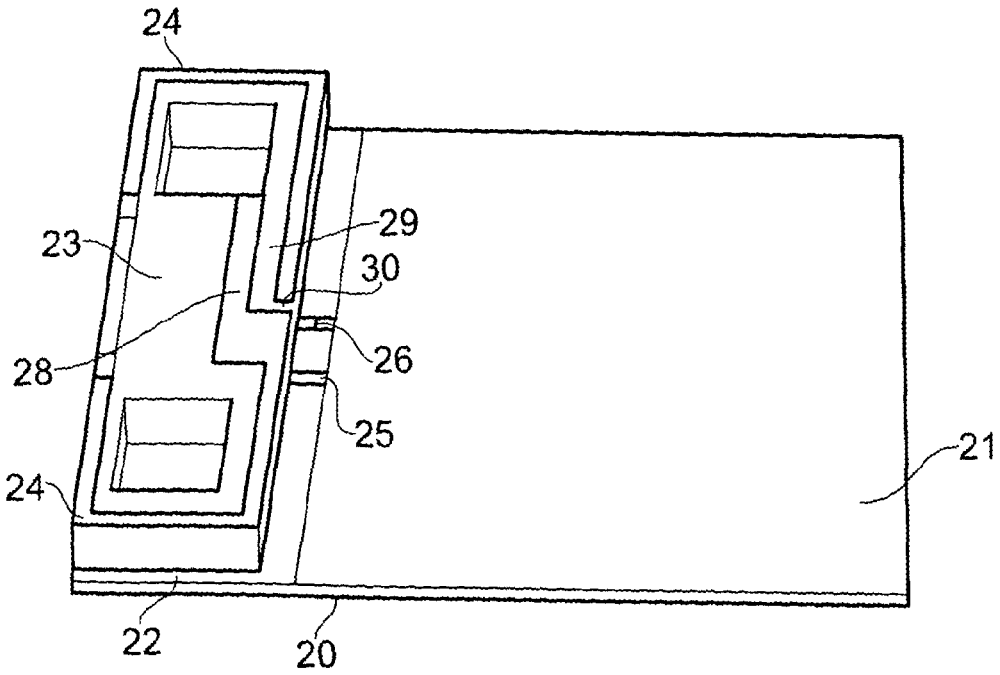
FIG. 3 shows an alternative embodiment in which an electrically complex central load is formed by a slot.

FIG. 3 shows a variation of the arrangement of FIG. 2, with like parts labelled as for FIG. 2. This embodiment provides an electrically complex (i.e. inductive and capacitive) load in the central region of the second surface of the substrate 23 by means of a stub 28 and slots 29, 30. This technique also adds inductance and capacitance near the center of the loop.

Figure 4:
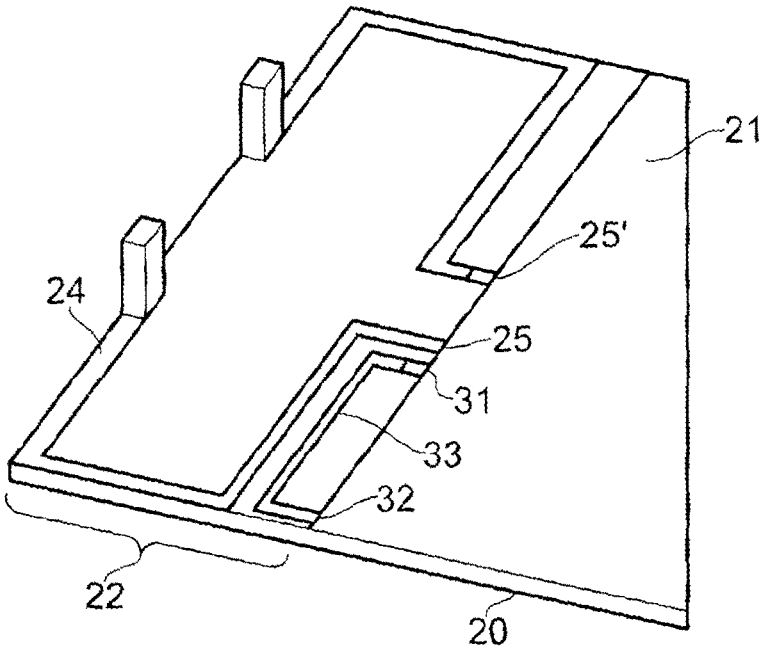
FIG. 4 shows an arrangement in which a separate feeding loop antenna is used to excite the main loop antenna by coupling inductively therewith.

FIG. 4 shows a variation (this time omitting the substrate 23 and top half of the antenna from the drawing for clarity) in which the main loop antenna defined by the conductive track 24 is connected at both terminals 25, 25' to ground 21. In other words, the main loop antenna is not directly driven by a feed 26 as in FIGS. 2 and 3. Instead, the main loop antenna is excited by a separate, smaller, driven loop antenna 33 formed on the end 22 of the PCB substrate 20 on which there is no groundplane 21, the driven loop antenna 33 having a feed 31 and a ground 32 connection. The smaller, driven loop antenna 33 may be configured to radiate at a higher frequency of interest, such as one of the WiFi frequency bands.

Figure 5:
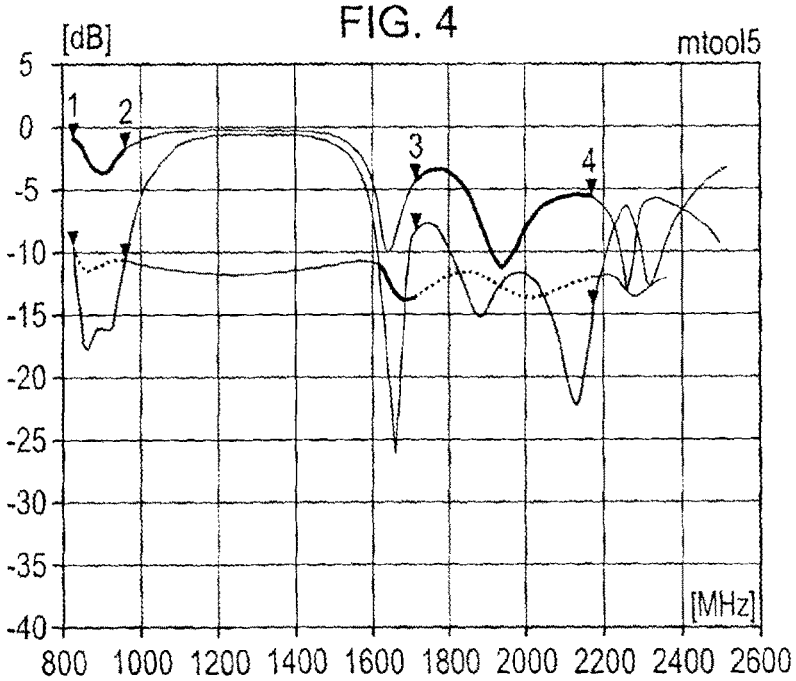
FIG. 5 is a plot showing the performance of the embodiment of FIG. 4, both before and after matching.

This inductively coupled feeding arrangement has many parameters that may be varied in order to obtain optimum impedance matching. An example of the performance of the antenna, before and after matching, is shown in FIG. 5. Lumped or tunable L and C elements may be added to the ground 32 of the small coupling loop 23 to adjust impedance response of the antenna as a whole.

In a variation of the inductive feeding of a parasitic loop antenna 33, the parasitic main loop may be fed capacitively by means of a short monopole on the underside of the main PCB substrate 20 coupling to a section of the antenna on the top side of the main PCB 20. This arrangement has been disclosed in a previous patent application, UK patent application No GB0914280.3 to the present applicant.

Figure 6:
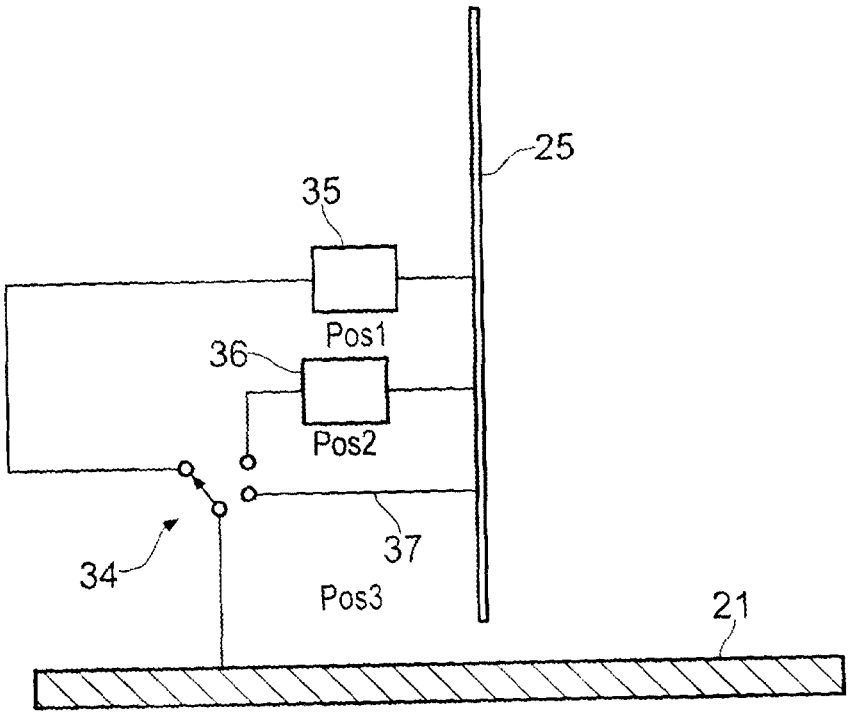
FIG. 6 is a schematic circuit diagram showing how embodiments of the present invention may be grounded through different loads.

Instead of directly grounding the main loop antenna, it is sometimes advantageous to ground the antenna through a complex load comprising inductors, capacitors or lengths of transmission line or any combination of these in series or parallel. Furthermore, the grounding point of the antenna may be switched between several different complex loads so as to enable the antenna to cover different frequency bands as shown in FIG. 6. FIG. 6 shows the grounding connection 25 and the groundplane 21 of the main PCB substrate 20. The grounding connection 25 connects to the groundplane 21 by way of a switch 34 that can switch in different inductive and/or capacitive components 35 or 36, or provide a direct connection 37. In the example shown below, the complex grounding loads were chosen so that in switch position 1 the low band of the antenna covered the LTE band 700-760 MHz; in switch position 2, 750-800 MHz and in switch position 3, the GSM band 824-960 MHz.

Figure 7:
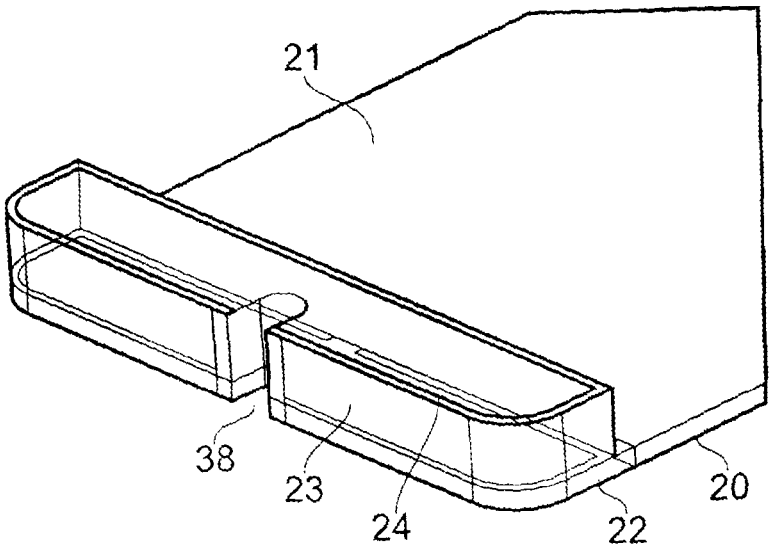
FIG. 7 shows an arrangement in which a loop antenna is vertically compacted across opposed sides of a dielectric substrate, and in which a central notch or cut-out is formed in the dielectric substrate.

It has been found that removing substrate 23 material in the region of high electric field strength may be used to reduce losses. In the example shown in FIG. 7, a central notch 38 has been cut into the substrate material 23 where the E-field is highest, resulting in improved performance in the high frequency band.

Figure 8:
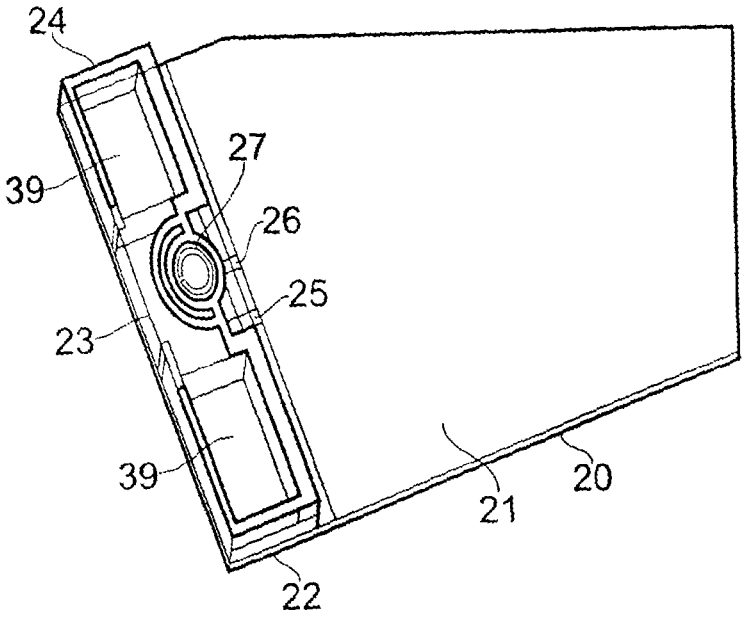
FIG. 8 shows a variation of the embodiment of FIG. 2, in which portions of the substrate are cut out or removed on either side of the central complex load.

FIG. 8 shows a variation of the embodiment of FIG. 2, where parts of the substrate 23 are cut out from the second surface on either side of the central complex load 27. In this example, the cut-outs are generally cuboidal in shape, although other shapes and volumes may be useful. The efficiency benefits are mainly in the high frequency band.

Figure 9:
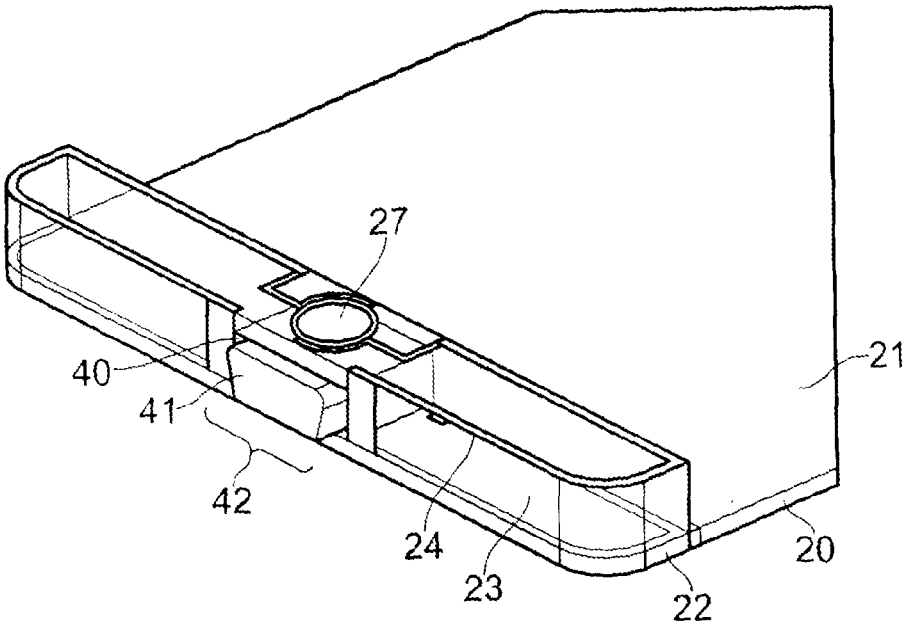
FIGS. 9 and 10 show a variation in which the loop antenna is arranged and the dielectric substrate cut through in such a way as to accommodate a connector, such as a micro USB connector.
Figure 10:
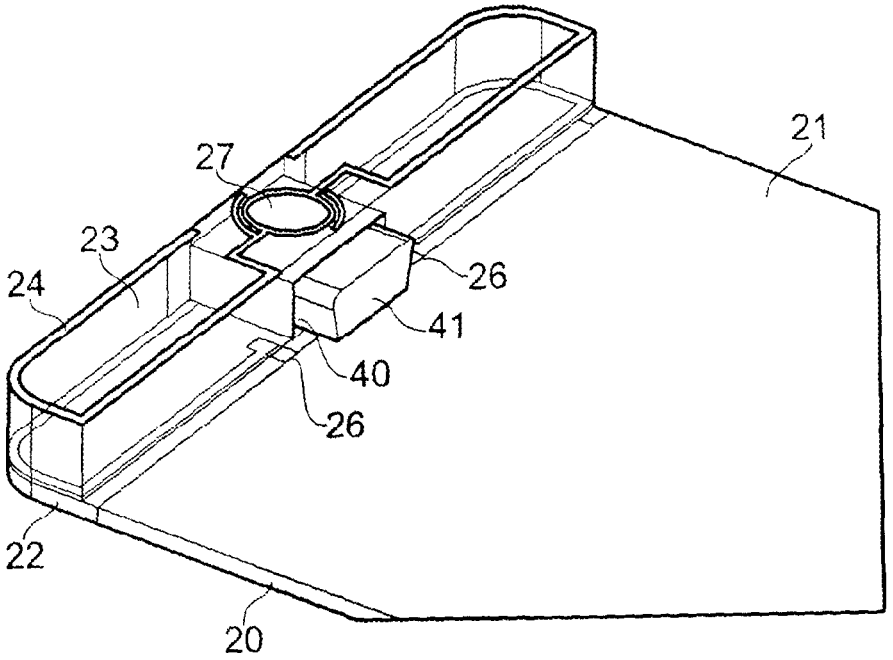

FIGS. 9 and 10 show a variation in which the main loop antenna is defined by the track 24 and complex load 27 on the substrate 23 is arranged so as to leave a central area 42 free for a cut-out 40 right through part of the antenna substrate 23. The objective here is not so much to reduce losses but rather to create a volume where a micro-USB connector 41 or similar may be located. It is often desirable to locate the antenna in the same place as connectors, for example at the bottom of a mobile phone handset.

Figure 11:
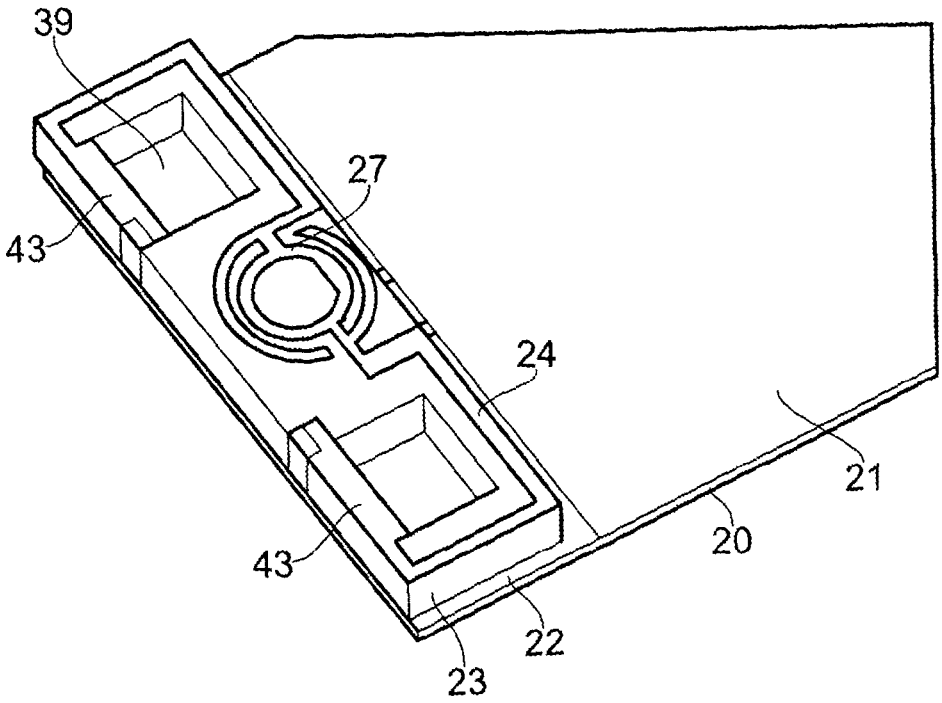
FIG. 11 shows a variation in which short capacitive or inductive stubs are attached to the loop antenna.

In a further embodiment it has found that short capacitive or inductive stubs 43 may be attached to a driven or parasitic loop antenna 24 to improve the bandwidth, impedance match and/or efficiency, as shown in FIG. 11. It has been found particularly advantageous to use several such stubs 43, as part of the central complex load 27. The stubs 43 may also be used advantageously when connected to other parts of the loop structure 24. Cut-outs 39 in the substrate 23 may also be provided to improve efficiency.

Figure 12:
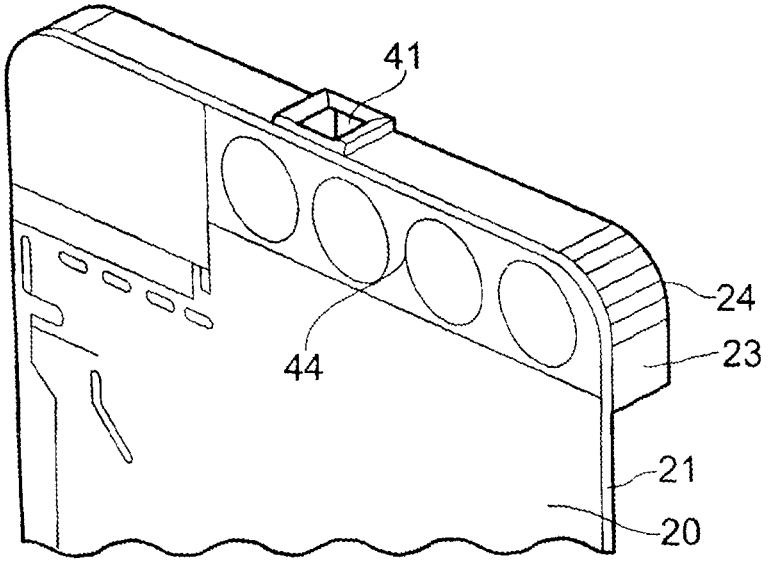
FIG. 12 shows an embodiment of the present invention combined with an FM radio antenna.

FIG. 12 shows an embodiment of the present invention corresponding generally to that of FIGS. 9 and 10 in combination with an electrically small FM radio antenna 44 tuned to band 88-108 MHz and mounted on the reverse side of the main PCB 20 to the side on which the loop antenna 24 is mounted. In other words, one antenna is on the top surface of the PCB 20 and the other is directly below it on the undersurface of the main PCB 20. It is usually a problem to use two antennas so closely spaced because of the coupling between them but it has been found that the loop design of embodiments of the present invention and the nature of the FM antenna (itself a type of loop) is such that very good isolation may exist between them.

Figure 13:
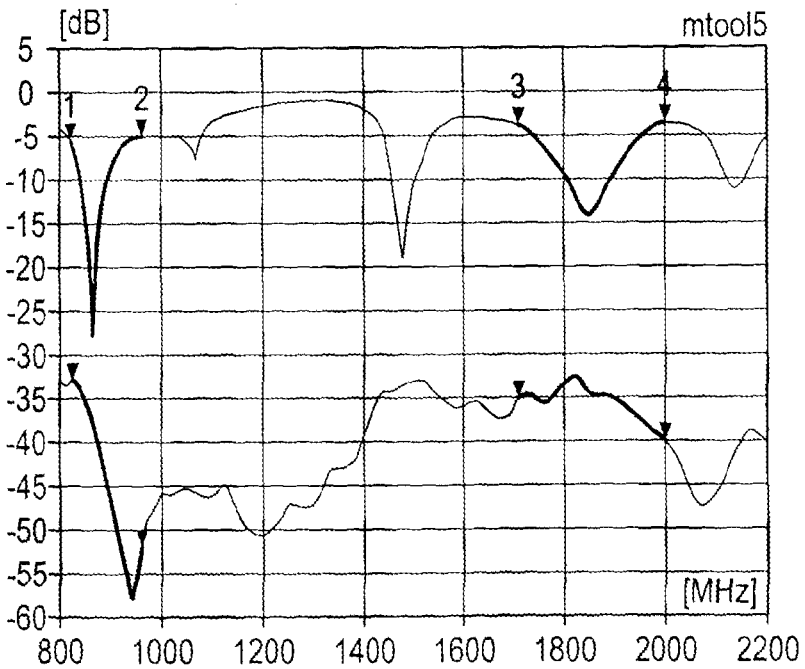
FIG. 13 is a plot showing coupling between the loop antenna and FM radio antenna of the embodiment of FIG. 12.

FIG. 13 shows that the coupling between the two antennas 24 and 44 (the lower plot) is lower than −30 dB across the whole of the cellular band.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. An antenna system comprising:

a parasitic loop antenna having a conductive track including a first arm and a second arm, the first arm extending from a first ground point across a first plane and extending from the first plane to a second plane, the first plane being separated from and substantially parallel to the second plane, the second arm extending from a second ground point across the first plane and extending from the first plane to the second plane, the first arm and the second arm further extending across the second plane, the first arm connecting to the second arm in the second plane.

2. The antenna system of claim 1 further comprising:

a separate, electrically driven antenna configured to drive the parasitic loop antenna.

3. The antenna system of claim 1 further comprising:

a separate, electrically driven antenna positioned in the first plane and configured to drive the parasitic loop antenna.

4. The antenna system of claim 1 further comprising:

a separate, electrically driven antenna configured to drive the parasitic loop antenna and taking the form of a smaller loop antenna located adjacent to a portion of the conductive track, the smaller loop antenna having a feed point and a ground point and being configured to drive the parasitic loop antenna by inductively coupling with the conductive track.

5. The antenna system of claim 1 further comprising:

a separate, electrically driven antenna configured to drive the parasitic loop antenna, the separate, directly driven antenna taking the form of a monopole antenna located and configured to drive the parasitic loop antenna by capacitively coupling with the conductive track.

6. The antenna system of claim 1 wherein the conductive track of the parasitic loop antenna is formed on a dielectric substrate, the dielectric substrate having a surface in the first plane and an opposing surface in the second plane.

7. The antenna system of claim 1 wherein the first arm connects to the second arm in the second plane at a conductive loading plate, the conductive loading plate being positioned in the second plane.

8. A device comprising:

an antenna assembly including:

a parasitic loop antenna having a conductive track including a first arm and a second arm, the first arm extending from a first ground point across a first plane and extending from the first plane to a second plane, the first plane being separated from and substantially parallel to the second plane, the second arm extending from a second ground point across the first plane and extending from the first plane to the second plane, the first arm and the second arm further extending across the second plane, the first arm connecting to the second arm in the second plane.

9. The device of claim 8 wherein the antenna assembly further comprises:

a separate, directly driven antenna configured to drive the parasitic loop antenna.

10. The device of claim 8 wherein the antenna assembly further comprises:

a separate, electrically driven antenna positioned in the first plane and configured to drive the parasitic loop antenna.

11. The device of claim 8 wherein the antenna assembly further comprises:

a separate, electrically driven antenna configured to drive the parasitic loop antenna and taking the form of a smaller loop antenna located adjacent to a portion of the conductive track, the smaller loop antenna having a feed point and a ground point and being configured to drive the parasitic loop antenna by inductively coupling with the conductive.

12. The device of claim 8 wherein the antenna assembly further comprises:

a separate, electrically driven antenna configured to drive the parasitic loop antenna, the separate, directly driven antenna taking the form of a monopole antenna located and configured to drive the parasitic loop antenna by capacitively coupling with the conductive track.

13. The device of claim 8 wherein the conductive track of the parasitic loop antenna is formed on a dielectric substrate, the dielectric substrate having a surface in the first plane and an opposing surface in the second plane.

14. The device of claim 8 wherein the first arm connects to the second arm in the second plane at a conductive loading plate, the conductive loading plate being positioned in the second plane.

15. A method comprising:

electrically driving a driving antenna at a feed point; and driving a parasitic loop antenna using the driving antenna, the parasitic loop antenna having a conductive track including a first arm and a second arm, the first arm extending from a first ground point across a first plane and extending from the first plane to a second plane, the first plane being separated from and substantially parallel to the second plane, the second arm extending from a second ground point across the first plane and extending from the first plane to the second plane, the first arm and the second arm further extending across the second plane, the first arm connecting to the second arm in the second plane.

16. The method of claim 15 wherein the driving antenna is positioned in the first plane.

17. The method of claim 15 wherein the driving antenna takes the form of a smaller loop antenna located adjacent to a portion of the conductive track, the smaller loop antenna having a feed point and a ground point and being configured to drive the parasitic loop antenna by inductively coupling with the conductive track.

18. The method of claim 15 wherein the driving antenna takes the form of a monopole antenna located and configured to drive the parasitic loop antenna by capacitively coupling with the conductive track.

19. The method of claim 15 wherein the conductive track of the parasitic loop antenna is formed on a dielectric substrate, the dielectric substrate having a first surface in the first plane and a second surface in the second plane.

20. The method of claim 15 wherein the first arm connects to the second arm in the second plane at a conductive loading plate, the conductive loading plate being positioned in the second plane.

* * * * *